US011457774B2

(12) United States Patent
Muthusamy

(10) Patent No.: US 11,457,774 B2
(45) Date of Patent: Oct. 4, 2022

(54) APPARATUS FOR DISPENSING LIQUID

(71) Applicant: Sharahwanaun Muthusamy, Petaling Jaya (MY)

(72) Inventor: Sharahwanaun Muthusamy, Petaling Jaya (MY)

( * ) Notice: Subject to any disclaimer, the term of this patent is extended or adjusted under 35 U.S.C. 154(b) by 0 days.

(21) Appl. No.: 17/175,434

(22) Filed: Feb. 12, 2021

(65) Prior Publication Data

US 2021/0251435 A1 Aug. 19, 2021

(30) Foreign Application Priority Data

Feb. 14, 2020 (MY) ..... PI2020000823

(51) Int. Cl.
*A47K 7/03* (2006.01)
*A47K 5/122* (2006.01)
*A47K 5/12* (2006.01)

(52) U.S. Cl.
CPC ..... *A47K 7/03* (2013.01); *A47K 5/1201* (2013.01); *A47K 5/1208* (2013.01); *A47K 5/122* (2013.01)

(58) Field of Classification Search
CPC . A47K 7/02; A47K 7/03; A47K 5/122; A47K 5/1208; A47K 5/1201; A61M 35/003; A61M 35/006; A45D 2200/1018; A45D 2200/1009; A45D 2200/1036; A45D 2200/1045
See application file for complete search history.

(56) References Cited

U.S. PATENT DOCUMENTS 4,617,875 A * 10/1986 Holland ..... A01K 13/003 401/281
8,128,303 B2 3/2012 LaFlamme et al.
8,313,442 B2 11/2012 Kassem
8,387,833 B2 3/2013 LaFlamme et al.
8,517,623 B2 8/2013 Cavaiani
8,590,752 B2 11/2013 Mileti
8,919,613 B2 12/2014 Mileti
9,433,191 B2 9/2016 Frye
9,877,619 B1 * 1/2018 Diaz ..... A47K 7/03
9,918,593 B2 3/2018 LeBlanc et al.
2011/0052306 A1 * 3/2011 Cavaiani ..... A46B 11/0079 222/105
2013/0058698 A1 3/2013 Hasidashvili
2016/0287033 A1 10/2016 LeBlanc et al.

FOREIGN PATENT DOCUMENTS

CN 106691272 A * 5/2017 ..... A47K 7/03
WO WO-2014015368 A1 * 1/2014 ..... A47K 5/1201

OTHER PUBLICATIONS

WIPO Application No. PCT/MY2021/050006, PCT International Search Report and Written Opinion of the International Searching Authority dated Mar. 30, 2021.

* cited by examiner

*Primary Examiner* — Patrick M. Buechner
(74) *Attorney, Agent, or Firm* — Alston & Bird LLP

(57) ABSTRACT

An apparatus (10) is provided for dispensing liquid. The device comprises a body (11) defining a reservoir (12) for holding liquid and a valve (14) in fluid communication with the reservoir (12) to allow liquid to be dispensed from the reservoir (12) when pressure is applied onto the body. A refill port (16) in fluid communication with the reservoir (12) allows liquid to be introduced into the reservoir (12). Furthermore, a plurality of scrubbing elements is provided for scrubbing and cleaning one or more surfaces.

13 Claims, 6 Drawing Sheets

APPARATUS FOR DISPENSING LIQUID

CROSS REFERENCE TO RELATED APPLICATIONS

This application claims priority to Malaysian Patent Application No. P12020000823 filed on Feb. 14, 2020, which is incorporated by reference in its entirety for all purposes.

FIELD OF INVENTION

The present invention relates to an apparatus used for cleaning. More particularly, the present invention relates to a dispenser for dispensing liquids onto a surface.

BACKGROUND OF INVENTION

Cleansing solutions such as liquid soap are basic cleaning aids which are used when bathing. Prior to the introduction of liquid soaps, solid bar soaps have been the most popular means used to aid in removal of dirt and other impurities from skin during bathing.

Bar soaps are disadvantageous as they are slippery when wet, and if not gripped properly, may slip out of hands and drop onto floor, becoming unhygienic as a result. Additionally, an improperly stored bar soap may leave an unpleasant residue and dry out. Since liquids such as liquid soaps are stored in a container prior to being poured out for use, they do not suffer such disadvantages.

While many people may prefer liquid soaps over bar soaps, some people may still prefer having the feeling of a solid object rubbed against their skin to improve the cleaning action which cannot be achieved using liquid soap alone. To this end, bathing accessories such as brushes, sponges and loofahs are used in conjunction with the liquid soaps to improve the bathing experience.

In view of the above, it is advantageous to provide a means to enable use of a liquid while providing an enhanced tactile feeling.

SUMMARY OF INVENTION

The present invention relates to an apparatus for dispensing liquid, comprising a body defining a reservoir for holding liquid, a second valve in fluid communication with the reservoir to allow liquid to be dispensed from the reservoir when pressure is applied onto the body, a refill port in fluid communication with the reservoir to allow liquid to be introduced into the reservoir and a plurality of scrubbing elements for scrubbing and cleaning one or more surfaces.

BRIEF DESCRIPTION OF FIGURES

The drawings constitute a part of this specification and include an exemplary or preferred embodiment of the invention, which may be embodied in various forms. It should be understood, however, the disclosed preferred embodiment is merely exemplary of the invention. Therefore, the figures disclosed herein are not to be interpreted as limiting, but merely as the basis for the claims and for teaching one skilled in the art of the invention.

DETAILED DESCRIPTION OF PREFERRED EMBODIMENT

Figure 1:
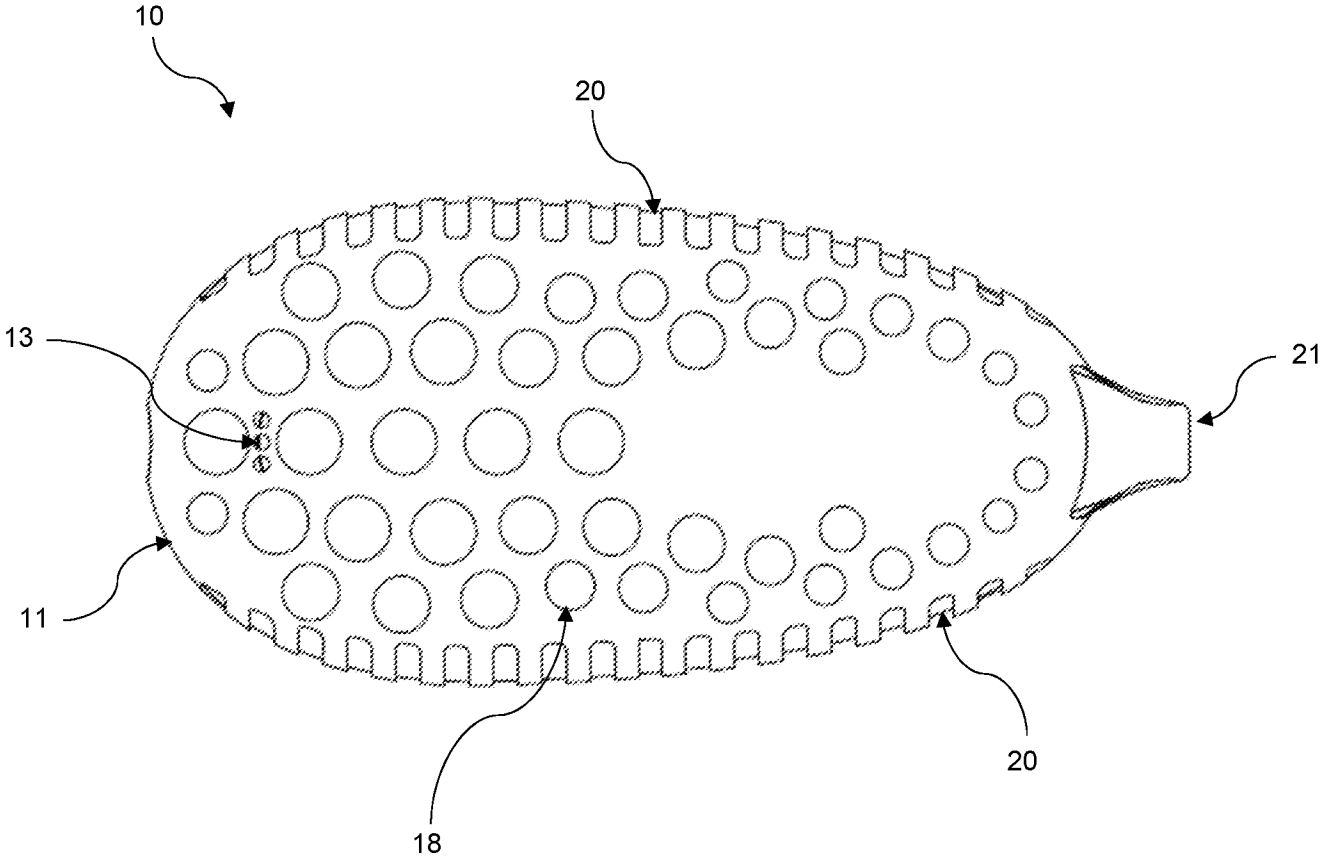
FIG. 1 shows a top perspective illustration of an apparatus for dispensing liquid, being a preferred embodiment of the present invention.

Detailed description of preferred embodiments of the present invention is disclosed herein. It should be understood, however, that the embodiments are merely exemplary of the present invention, which may be embodied in various forms. Therefore, the details disclosed herein are not to be interpreted as limiting, but merely as the basis for the claim and for teaching one skilled in the art of the invention. The numerical data or ranges used in the specification are not to be construed as limiting.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose. For example, the terms top, bottom, front, back, upper, lower, left, right, first, second, third, fourth, and the like, are intended as relative terms for facilitating an understanding of the illustrated embodiments, and not as absolute limiting terms for the invention being claimed.

The term "liquids" used throughout the specification shall be taken to refer to any fluids that are used to aid in cleaning a surface or body and may contain stearates, salts, fragrances, surfactants, humectants, exfoliants and other compounds known to a person having ordinary skill in the art.

FIGS. 1-7 show an apparatus (10) for dispensing liquid, the apparatus (10) being a preferred embodiment of the present invention.

Referring now to FIG. 1, a top perspective illustration of the apparatus (10) may be seen. The apparatus (10) is intended to function as a cleaning accessory that enables use of liquid cleansing solution in lieu of a traditional cleansing solution bar while providing a tactile feel for a user who may prefer a bathing accessory having a textured surface for cleaning.

The apparatus (10) comprises a squeezable, resilient and hollow body (11) that is fabricated from any elastomeric material such as silicone. To improve durability, the body (11) is moulded as a single piece instead of separate pieces which are then fused together. Alternatively, the body (11) is made from more than one piece which are then fused together. The body (11) is made using a compression mould or other similar processes so as to ensure structural integrity of the body (11) during multiple/prolonged times of squeezing action. This also ensures uniform compression and decompression of the body (11). Preferably, the body (11) has a substantially teardrop shape that provides improved ergonomic comfort when holding and squeezing, enabling the apparatus (10) to be hand-holdable.

A plurality of scrubbing elements such as raised studs (18) are preferably disposed at top portion of the body (11) to improve gripability of the body (11) and to also provide a cleaning/scrubbing effect when the plurality of studs (18) is rubbed against a surface. The plurality of studs (18) may be in the shape of rounded, cylindrical or conical protrusions or any other conceivable shapes. Preferably, the plurality of studs (18) is integrally formed with the body (11) and are formed when the body (11) is moulded.

Figure 2:
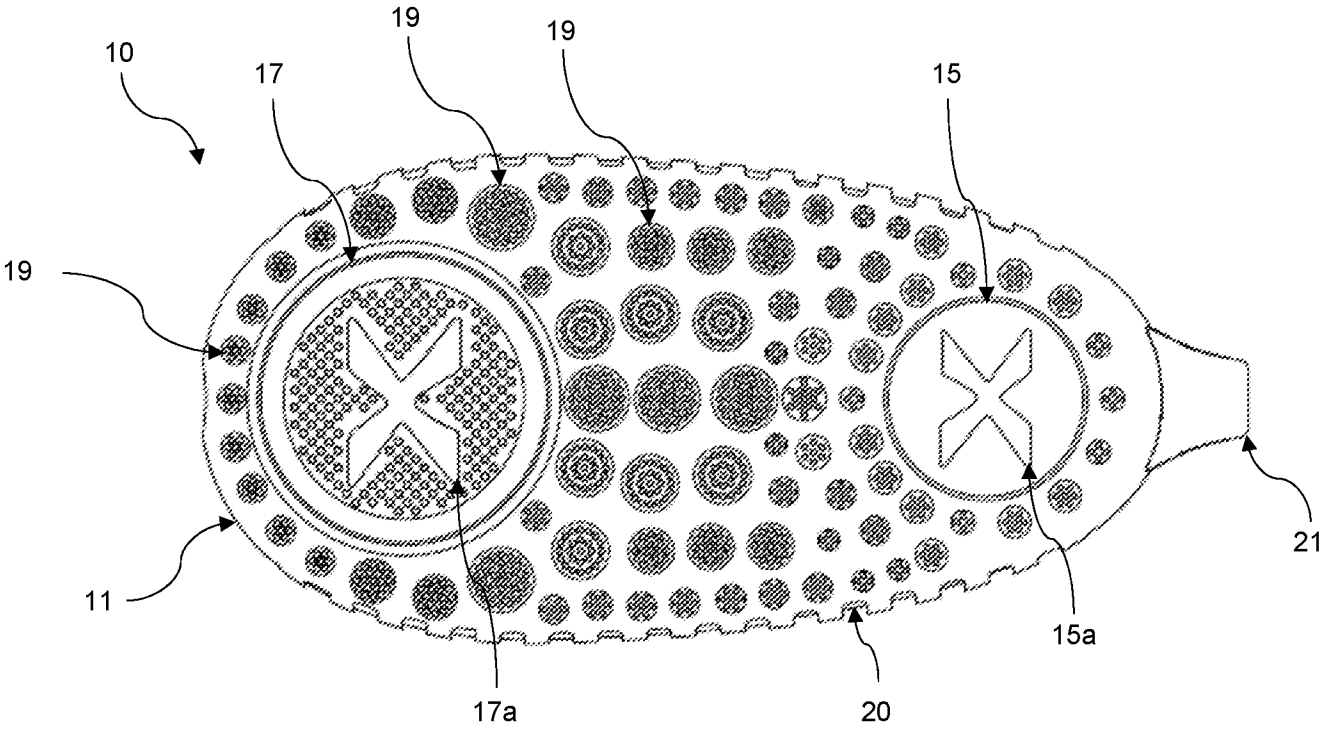
FIG. 2 shows a bottom perspective illustration of the apparatus shown in FIG. 1.

Referring now to FIG. 2, a bottom perspective illustration of the apparatus (10) may be seen. A plurality of scrubbing elements such as bristle clusters (19) are preferably disposed at bottom side of the body (11). The plurality of bristle clusters (19) provides a cleaning/scrubbing effect when bristle clusters (19) are rubbed against a surface. In the non-limiting example shown in FIG. 2, each bristle clusters (19) may vary in number of bristles, bristle size, bristle height and diameter from one bristle cluster to another bristle cluster. As with the plurality of studs (18), the plurality of bristle clusters (19) is integrally formed with the body (11).

A valve cap (15) is provided and is fastenable over a valve (shown as 14 in FIG. 4) to prevent liquids from being inadvertently squeezed out from the body (11) when not in use. Preferably, the valve cap (15) includes male threads which correspond with female threads provided on the body (11) to enable fastening of the valve cap (15) over the valve (14). The valve cap (15) also includes a raised protrusion (15*a*) that enables manipulation by fingers to twist the valve cap (15) open or close. In the non-limiting example shown in FIG. 2, the protrusion is X-shaped. The protrusion (15*a*) also assists in opening and closing of a refill valve port cap (17*a*) which will be explained in greater detail in a later part of this description.

Figure 3:
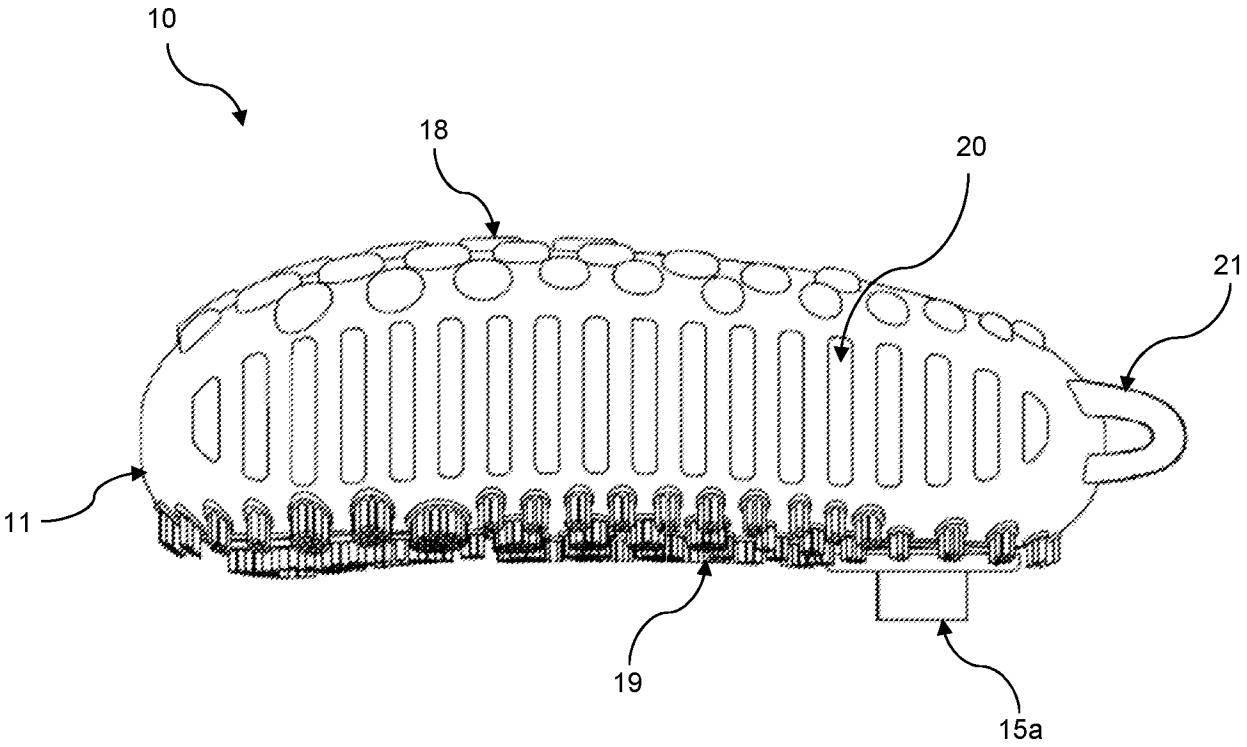
FIG. 3 shows a side perspective illustration of the apparatus shown in FIG. 1.

Referring now to FIG. 3, a side perspective illustration of the apparatus (10) may be seen. A plurality of side grooves (20) disposed on left and right sides of the body (11) are provided to improve gripability and also provide a scrubbing effect when the plurality of side grooves (20) is rubbed against a surface. The side grooves (20) may be in perpendicular, angular, concentric circular order, wave-like pattern or a combination thereof. The plurality of bristles (19), the plurality of studs (18) and the plurality of side grooves (20) in combination provide a varied tactile sensation for a user when using the apparatus.

Figure 4:
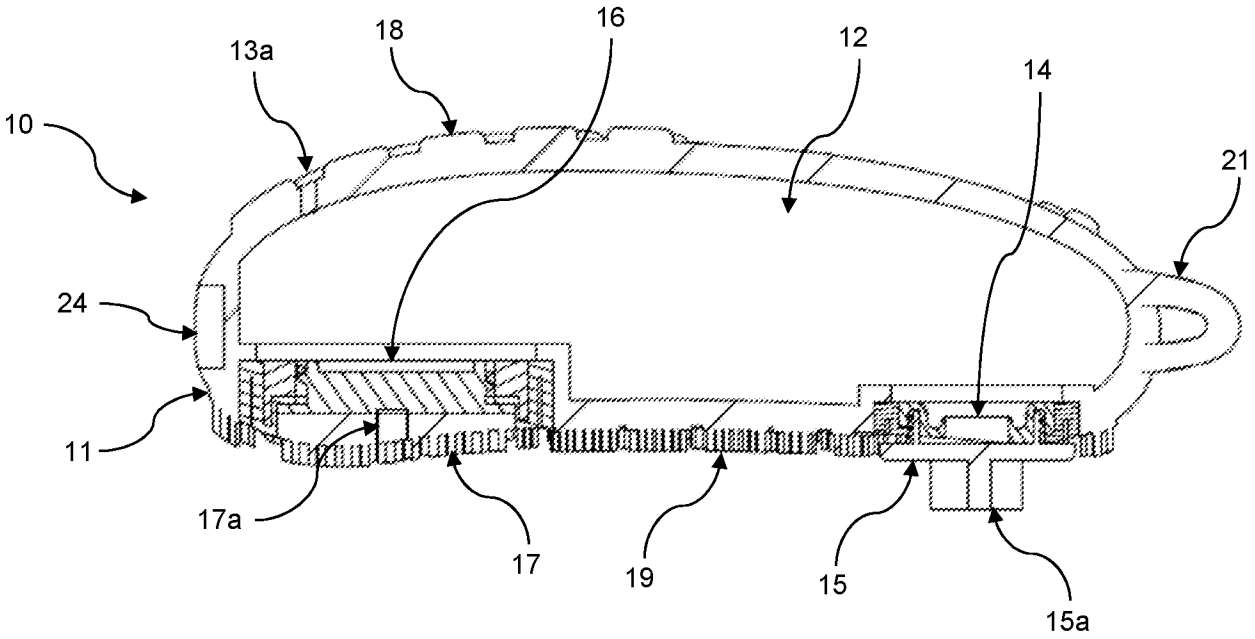
FIG. 4 shows a side cross-sectional illustration of the apparatus shown in FIG. 1.

Referring now to FIG. 4, a side cross-sectional illustration of the apparatus (10) may be seen. As can be seen from this figure, the body (11) defines a reservoir (12) which holds liquid. The liquid may be squeezed out of the body (11) through a second valve (14) which is in fluid communication with the reservoir (12). The volume of the reservoir (12) is between 50-200 ml. It is envisioned that the volume of reservoir (12) is larger if intended for applications that require a higher volume of liquid such as washing cars. The second valve (14) is secured to the body (11). The second valve (14) preferably includes resilient members that open and allow liquid to exit when the liquid dispenser (10) is squeezed and close and prevent liquid from exiting when no pressure is applied onto the liquid dispenser (10). Preferably, the second valve (14) component is obtainable from valve manufacturing companies.

It is recognized that the body (11), once squeezed, may take a while to return to its original shape due to the second valve (14) partially restricting entry of air into the reservoir (12). Optionally, a first valve (13) such as an umbrella valve in fluid communication with the reservoir may be provided to assist the body (11) in returning to its original shape after being squeezed. The first valve (13) is secured to the body (11).

The first valve (13) allows one-way entry of air through an aperture (13*a*) into the reservoir (12) while preventing liquid in the reservoir (12) from exiting. Thus, when the body (11) is squeezed, liquid exits the reservoir (12) via the second valve (14) but not via the first valve (13) and when the body (11) is released, air will enter the reservoir (12) via the first valve (13) to help enable a smooth and quick return of the compressed body (11) to its original shape.

A refill port (16) is provided to allow liquid to be refilled into the reservoir (12). The refill port (16) is capped with a refill port cap (17) that is configured in a similar manner as the valve cap (15). The refill port (16) is secured to the body (11).

In the non-limiting example shown in FIG. 2, the refill port cap (17) includes an X-shaped depression (17*a*) that corresponds with the X-shaped protrusion (15*a*). The X-shaped protrusion (15*a*) may be placed into the X-shaped depression (17*a*) and twisted in a counter-clockwise direction to unfasten the refill port cap (17) and twisted in a clockwise direction to fasten the refill port cap (17). Conceivably, the protrusion (15*a*) and depression (17*a*) need not be limited to an X-shape as illustrated in FIG. 2 and may take on any shape that allows torque to be transmitted from the protrusion (15*a*) to the depression (17*a*).

Figure 5:
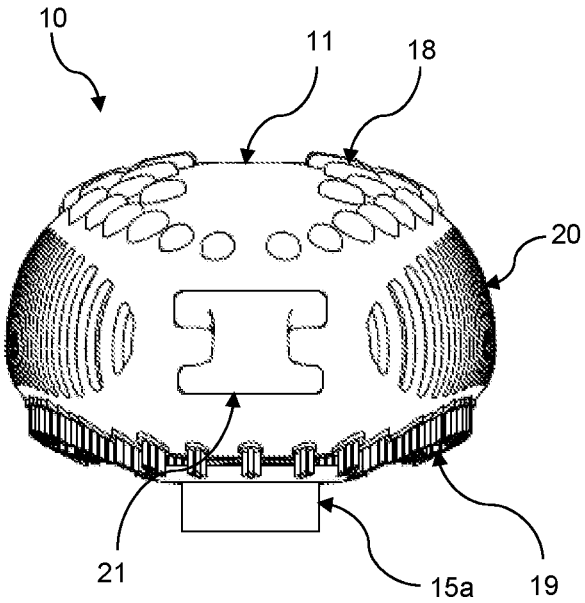
FIG. 5 shows front perspective illustration of the apparatus shown in FIG. 1.

Referring now to FIG. 5, a front perspective illustration of the apparatus (10) may be seen. Preferably, a loop (21) is provided at narrow end of the body (11) to enable a lanyard, cord, or the like to be passed through so that the liquid dispenser (10) may be hung when not in use. As with the plurality of studs (18), the loop (21) is integrally formed with the body (11).

Where it may not be apparent, adding a lanyard to the loop (21) allows the apparatus (10) to be slung from a user's forearm via the lanyard during cleaning and reduces likelihood of the apparatus (10) being dropped. If not in use, the apparatus (10) may be hung at a desired location such as a shower faucet.

Figure 6:
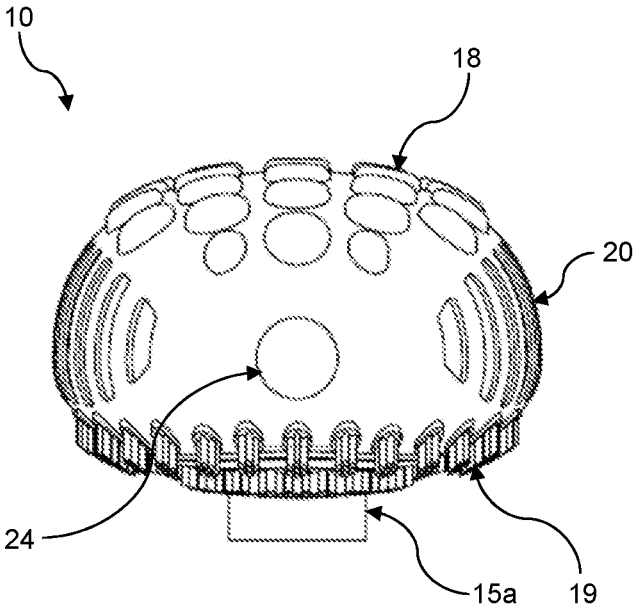
FIG. 6 shows a rear perspective illustration of the apparatus shown in FIG. 1.

Referring now to FIG. 6, a rear perspective illustration of the apparatus (10) may be seen. Instead of passing a lanyard through the loop (21), a receptacle (24) may be formed at larger end of the body (11) to enable a lanyard (illustrated as 22 in FIG. 7) to be removably attached to the body (11).

Figure 7:
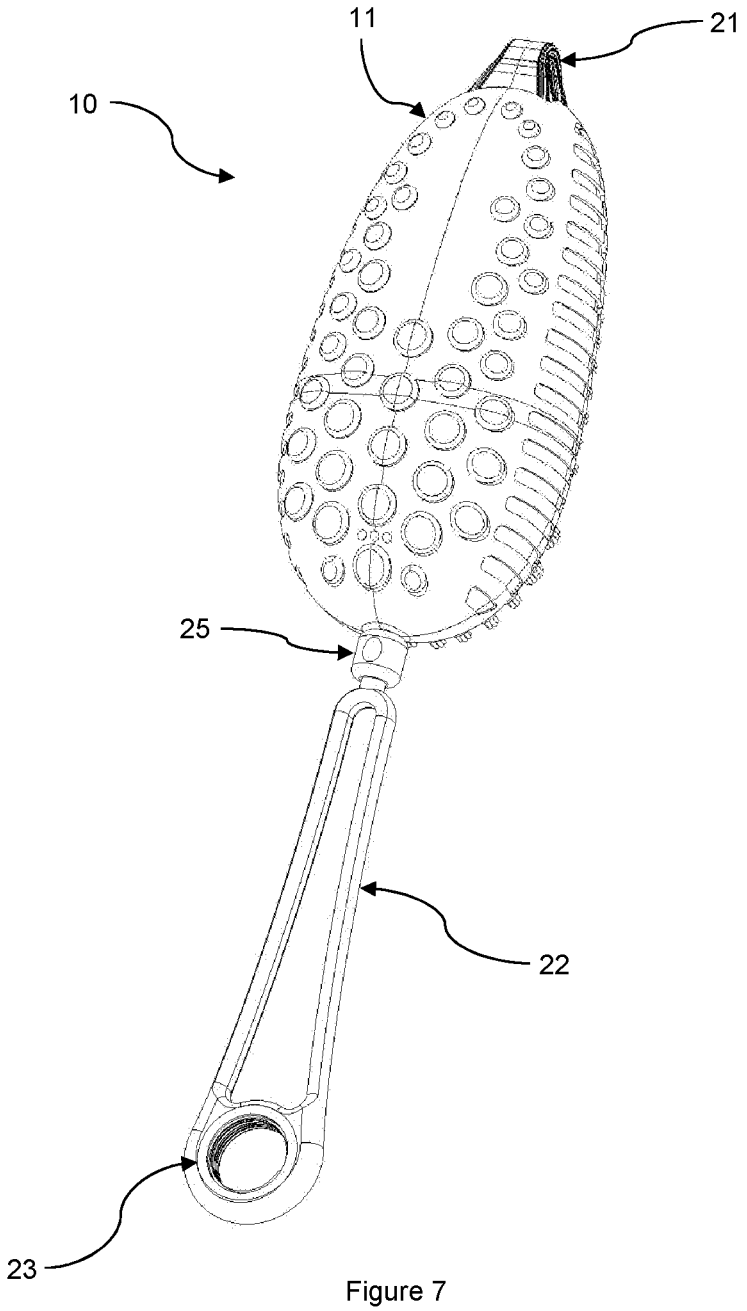
FIG. 7 shows a rear isometric illustration of the apparatus with an attached lanyard.

Referring further to FIG. 7, a lanyard (22) which is connected to an end (25) which includes a joint (not illustrated) which allows the end (25) to be releasably connected to the receptacle (24) via the ball joint. The joint is securable with the receptacle (24) by connections means such as screw connection. The lanyard (22) may also include a loop (23) that is able to hold the valve cap (15) while the apparatus (10) is used which reduces likelihood of misplacing the valve cap (15).

Apparatus (10) for bathing animals, washing articles such as crockery, vehicles may not have scrubbing elements as described and can be replaced or covered with textile fabrics and/or different scrubbing materials which provide a suitable scrubbing effect. The apparatus (10) may be adapted onto an external component that comprises a larger body to provide a larger surface contact area whereby the apparatus (10) dispenses liquid while the external component scrubs and cleans a contacted surface. Optionally, the apparatus (10) has a handle for easy maneuvering and/or extension arm for reaching a distanced surface.

The invention being thus described, it will be readily appreciated by those skilled in the art that modifications may be made to the invention without departing from the embodiments as disclosed therein. Such modifications are to be considered as included in the following claims unless the claims by their language expressly state otherwise.

The invention claimed is:

1. An apparatus for dispensing liquid, comprising:

a body defining a reservoir for holding liquid;

a valve in fluid communication with the reservoir to allow liquid to be dispensed from the reservoir when pressure is applied onto the body;

a valve cap;

a refill port in fluid communication with the reservoir to allow liquid to be introduced into the reservoir; and at least one scrubbing element for scrubbing and cleaning a surface, characterized in that:

a valve cap closeable over the valve includes a protrusion; and a refill port cap closable over the refill port includes a depression, wherein the protrusion has a shape corresponding with a shape of the depression to allow the refill port cap to be fastened and unfastened using the valve cap, and wherein egression of liquid from the reservoir is prevented when the valve cap is fastened.

2. The apparatus as claimed in claim 1, wherein the body is a resilient single-part.

3. The apparatus as claimed in claim 1, wherein the apparatus is in a tear-drop shape.

4. The apparatus as claimed in claim 1, wherein the apparatus is hand-holdable.

5. The apparatus as claimed in claim 1, further comprising a plurality of side grooves formed onto the body.

6. The apparatus as claimed in claim 5, wherein the side grooves are perpendicular, angular, concentric circular order, wave shaped pattern or a combination thereof.

7. The apparatus as claimed in claim 1, wherein the protrusion and depression are X-shaped.

8. The apparatus as claimed in claim 1, wherein the refill port cap is closable over the refill port to form a watertight seal preventing egress of liquid from the reservoir via the refill port.

9. The apparatus as claimed in claim 1, further comprising a loop integrally formed with the body.

10. The apparatus as claimed in claim 1, further comprising a receptacle to enable a lanyard to be removably attached to the body.

11. The apparatus as claimed in claim 1, wherein the plurality of scrubbing elements are grooves, studs and/or bristles.

12. The apparatus as claimed in claim 1, further comprising another valve to allow one-way entry of air into the reservoir.

13. The apparatus as claimed in claim 1, wherein the liquid is selected from a group consisting of shampoo, liquid soap, conditioner, lotion and detergent or a combination thereof.

* * * * *